US007255319B2

(12) United States Patent
Albano

(10) Patent No.: US 7,255,319 B2
(45) Date of Patent: Aug. 14, 2007

(54) FORM FRAME FOR CONCRETE FOOTINGS HAVING MEANS TO PREVENT RELATIVE MOVEMENT BETWEEN THE FORM BOARDS AND THE GROUND SURFACE

(76) Inventor: Rocchino Albano, 1133 Shoecraft Rd., Webster, NY (US) 14580

( * ) Notice: Subject to any disclaimer, the term of this patent is extended or adjusted under 35 U.S.C. 154(b) by 459 days.

(21) Appl. No.: 10/830,720

(22) Filed: Apr. 23, 2004

(65) Prior Publication Data

US 2005/0241264 A1 Nov. 3, 2005

(51) Int. Cl.
*E04G 11/08* (2006.01)
*B25B 11/00* (2006.01)

(52) U.S. Cl. ..... 249/34; 249/5; 269/43

(58) Field of Classification Search ..... 249/34, 249/2, 3, 4, 5, 6, 7, 8, 208, 216, 213, 210; 52/741.15, 745.12; 269/43, 37, 45, 152; 33/518, 613, 645

See application file for complete search history.

(56) References Cited

U.S. PATENT DOCUMENTS

| | | | | | |
|---|---|---|---|---|---|
| 733,396 | A * | 7/1903 | Jarvis | 249/9 |
| 1,067,420 | A * | 7/1913 | Forbis | 249/5 |
| 1,405,650 | A * | 2/1922 | Wilson | 249/37 |
| 1,644,586 | A * | 10/1927 | Heltzel | 249/5 |
| 1,651,041 | A * | 11/1927 | Richards | 269/43 |
| 2,581,403 | A * | 1/1952 | Gabrielson | 269/45 |
| 2,669,013 | A * | 2/1954 | Wilson | 269/152 |
| 2,711,573 | A * | 6/1955 | Bliss | 249/210 |
| 3,207,465 | A * | 9/1965 | Papin | 249/34 |
| 3,650,521 | A | 3/1972 | Meli | |
| 3,722,849 | A | 3/1973 | Luyben | |
| 4,029,288 | A * | 6/1977 | Murphy et al. | 249/216 |
| 4,339,106 | A * | 7/1982 | Navarro | 249/219.1 |
| 5,016,855 | A * | 5/1991 | Huggins | 249/21 |
| 5,058,854 | A * | 10/1991 | Bravo | 249/2 |
| 5,156,753 | A * | 10/1992 | Speidel | 249/5 |
| 5,343,667 | A * | 9/1994 | Peden | 249/5 |
| 6,234,447 | B1 | 5/2001 | Boyden et al. | |
| 6,343,894 | B1 | 2/2002 | Fearn | |
| 6,390,440 | B1 * | 5/2002 | Morin | 249/34 |
| 2003/0029130 | A1 * | 2/2003 | Humphrey | 52/742.1 |

* cited by examiner

*Primary Examiner*—Michael Safavi
(74) *Attorney, Agent, or Firm*—Rodney A. Corl

(57) ABSTRACT

A square tubular steel frame extends between inner and outer concrete footing form walls and prevents the inner and outer form walls from bowing inwardly and causing an undesirable narrow footing width, or bowing outwardly and causing a form blowout. The steel frame is adjustable in width to accommodate the narrowest to the widest footings. A lower bracket supports the bottom of the form, and is adjustable in height. Each end of the frame is replaceable to accommodate a single form thickness, or to accommodate overlapping forms. The frame is reusable, easy to set up, and simple to take down and move to the next job, and is safe to use.

2 Claims, 2 Drawing Sheets

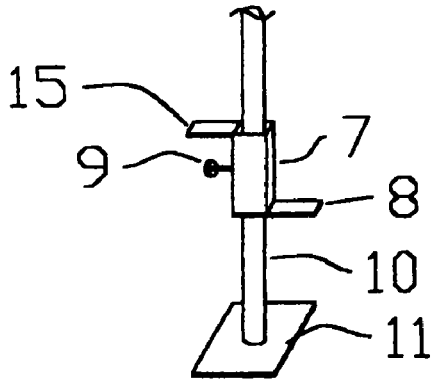
Fig. 3
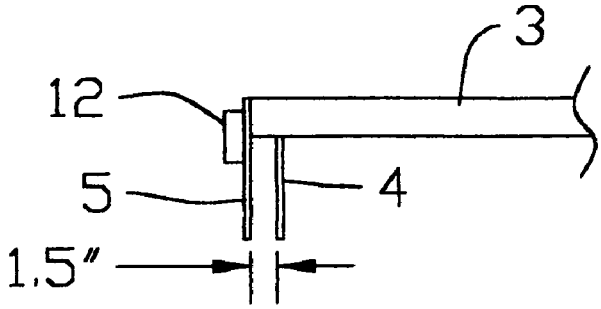
Fig. 4a
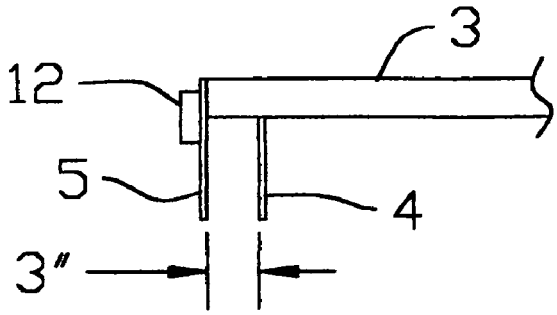
Fig. 4b
Fig. 4

FORM FRAME FOR CONCRETE FOOTINGS HAVING MEANS TO PREVENT RELATIVE MOVEMENT BETWEEN THE FORM BOARDS AND THE GROUND SURFACE

BACKGROUND OF THE INVENTION

The present invention relates to the masonry field, especially to the art of laying up forms in which concrete footings are poured. Forms for concrete footings are set up with an inner and outer wall and are usually made of dimensional lumber or heavy plywood panels, or may even be manufactured aluminum panels. The inner and outer walls confine the liquid concrete and give it its final shape and dimension. Depending on the type of structure being set on these footings, the inner and outer walls may be spaced apart 12 inches, 16 inches, 24 inches or wider. Problems occur when the concrete confined between the inner and outer walls exerts a force on the forms pushing them apart until they collapse under the force resulting in what's known as a blowout. Blowouts not only cause loss of money to the contractor due to the loss of the concrete that escapes the forms, but much labor is needed to clean up the blowout and to reset the forms.

Another problem that is encountered when pouring the footings is that the top edges of the forms sometimes tend to curve inward toward each other due to the forces pushing outwardly at the bottom edges of the forms. This can result in an upper surface of the footing being too narrow to pass inspection. If this happens, the entire footing must be redone to get the proper width to meet local building codes.

Efforts have been made to correct these undesirable situations. A typical approach is to nail wooden spacers across the top of wooden forms, and to drive support stakes alongside the forms and to nail the forms to the stakes. While this approach can be effective in some circumstances, the wooden spacers are generally not reusable, are not adjustable, and do not have the strength required for large forms with a large width. Driving stakes into the ground is labor intensive, and can result in injuries due to missing the stakes with the sledge hammer and striking ones hands. Further, wooden spacers and supporting stakes cannot be used on aluminum forms at all. Another approach is to use metal clips that clip between the upper edges of the inner and outer form walls. Again, these clips do not have the necessary strength for large forms and they are not adjustable.

BRIEF SUMMARY OF THE INVENTION

The present invention overcomes the drawbacks of these prior attempts to constrain the forms to the desired width. The present invention provides a steel frame of high strength that extends between the inner and outer form walls and prevents the form walls from bowing inwardly and narrowing the footing, and prevents the forms from blowing out. The steel frame is adjustable to accommodate form widths from 16 inches or less to 24 inches or more. The steel frame is reusable, easy to put into place on the forms, and simple to take down and make ready for the next job. The use of the frame of the present invention can result in a savings in labor costs to the contractor, not only in setting up forms for a concrete pour and taking down forms, but in saved labor due to not having to redo footings or cleaning up from blowouts. The use of the frames of the present invention is also safer, as no hammering of nails or stakes is necessary.

The frame of the present invention consists of a square tubular spanning member that is telescopically adjustable in width, and which extends between the inner and outer walls of the form. The tubular member is infinitely adjustable between its minimum and maximum widths, allowing for use on any width forms. On each end of the tubular member are inner and outer bracket members which extend down the inside and outside of the form wall preventing the form from bowing inwardly or blowing outwardly. Once placed over the inner and outer form walls and locked at the desired width by locking screw means, the inner and outer form walls are essentially fixed in place relative to each other. Multiple frames can be placed on the forms, at desired distances from each other, as each particular job dictates.

BRIEF DESCRIPTION OF THE DRAWINGS

The invention will be further described in connection with the accompanying drawings, in which:

FIG. 3 is perspective of lower support member, and,

FIG. 4 shows a front view of interchangeable frame members.

DETAILED DESCRIPTION

Figure 1:
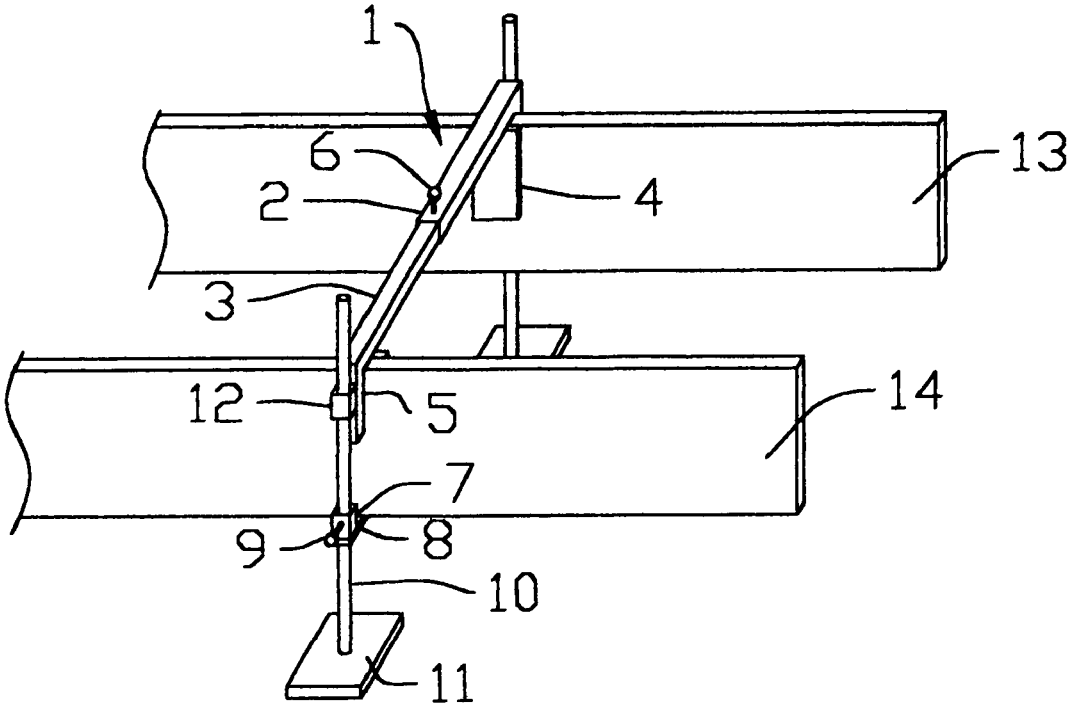
FIG. 1 is a perspective view of the frame in use on footing forms.
Figure 2:
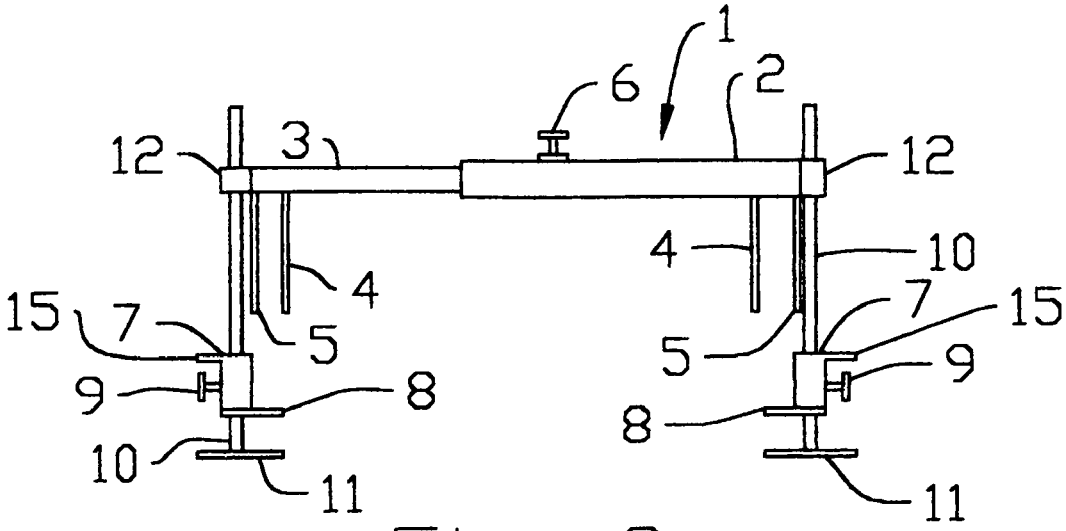
FIG. 2 is a front view of the frame with lower support in use.

Referring to FIG. 1, frame 1 is shown in use on concrete footing forms 13 and 14. Forms 13 and 14 are typically made of dimensional lumber, but may be made of heavy weight plywood or even of lightweight metal such as aluminum. Form 14 determines the inner wall of the concrete footing while form 13 determines the outer wall of the concrete footing. Frame 1 consists of square tubular steel member 3 which telescopically slides within square tubular steel member 2, allowing for adjustment of the frame 1 to accommodate any width of form setup. Once adjusted to the desired width, locking screw 6 is tightened through member 2 and against member 3 to lock member 3 in fixed position relative to member 2. Tubular steel member 3 could also have holes or indents at fixed positions along its length to allow for specific adjustments, such as widths of 16 inches, 18 inches, 24 inches, etc. Tubular steel members 2 and 3 each have at their outer ends bracket members 4 and 5. FIG. 2 shows detail of the position of bracket members 4 and 5. Bracket member 4 is placed on tubular steel members 2 and 3 such that it engages the inner vertical surface of forms 13 and 14, while bracket member 5 is placed on tubular steel members 2 and 3 such that it engages the outer vertical surface of forms 13 and 14. In operation, with the tubular steel member 3 fixed from movement relative to tubular steel member 2 by locking screw 6, and with the bracket members 4 and 5 at each end of tubular steel members 2 and 3 placed over the top of forms 13 and 14 such that bracket members 4 engage the inner vertical surfaces of forms 13 and 14 and bracket members 5 engage the outer vertical surfaces of forms 13 and 14, forms 13 and 14 are prevented from bowing inwardly due to the inwardly constraining action of bracket members 4, and blowouts of the forms are prevented due to the outwardly constraining action of bracket members 5.

Another feature of the invention is the addition of vertically restraining bracket member 8, seen in FIGS. 1 and 2 and in detail in FIG. 3. Bracket member 8 is attached to square tubular steel member 7 which is slidably positioned over rod 10. A locking screw 9 is threaded through tubular steel member 7 and tightens against rod 10 to lock the member 7 against movement relative to rod 10. Rod 10 is attached to a base 11 to support the frame relative to the ground, and passes through a channel member 12 attached at the outer end of tubular steel members 2 and 3. Restraining bracket member 8 engages the bottom horizontal surface of forms 13 and 14, supporting the forms against vertical movement. Also, an outer bracket member 15 may be attached to tubular steel member 7. Bracket members 8, attached to square tubular steel members 7, and slidably positioned over rods 10, can be attached to frame 1 through channel member 12 where needed, or may be positioned along forms 13 or 14 independent of frame 1, anywhere as is necessary to support the forms. Steel rods could also be driven through channel members 12 and into the ground to add extra lateral support to the forms. Providing channel members 12 allow a rod to be driven by one man without danger of smashing his hand, by supporting the rod while it is being driven.

FIG. 4 shows another feature of the present invention. When footing forms are laid up, ends of forms are overlapped to prevent leaking of concrete at the joint and to give strength to the joint in the forms. The thickness of the form at this point is twice that of the form where they are not overlapped. Tubular steel members 2 and 3 can be made with bracket members 4 and 5 spaced for normal form thickness, as shown in FIG. 4*a*, or can be spaced for double form thickness as shown in FIG. 4*b*. If dimensional lumber is used for forms 13 and 14, then the thickness is 1½ inches, so bracket members 4 and 5 are spaced 1½ inches apart as in FIG. 4*a*. Where the dimensional lumber forms 13 and 14 have overlapping joints, the thickness of the forms would be 3 inches, so the bracket members 4 and 5 are spaced 3 inches apart, as shown in FIG. 4*b*. If the inner wall of the form 14 has an overlapping section, while the outer wall of the form 13 does not, then a frame member 3 with the wider spacing of FIG. 4*b* can be fitted with frame member 2 having a normal spacing of FIG. 4*a*, or vice-versa.

It can be seen from the above description that the frame 1 has many advantages over the previous methods of preventing concrete footing forms from bowing inwardly or blowing out. The frame 1 is easy to put into place, is adjustable for any width of footing, prevents movement of the forms not only horizontally but also vertically, and can accommodate forms of normal thickness or of double thickness where they overlap.

While a preferred embodiment of the invention has been illustrated and described, it will be apparent that various changes can be made in the disclosed embodiment without departing from the scope or spirit of the invention, as set forth in the following claims.

I claim:

1. A frame for preventing relative movement between a concrete footing form inner and outer form walls, said frame being affixed to, and extending between, said inner and outer form walls along an upper portion of said form walls, said frame comprising:

a first tubular member having an inner portion and outer portion, said outer portion having an inside bracket member and an outside bracket member, each bracket member being affixed to the underside of said outer portion, said inside bracket member extending downwardly from said outer portion and engaging an inner surface of one of said inner and outer form walls, said outside bracket member extending downwardly from said outer portion and engaging an outer surface of one of said inner and outer form walls, a second tubular member having an inner portion and outer portion, said outer portion having an inside bracket member and an outside bracket member, each bracket member being affixed to the underside of said outer portion, said inside bracket member extending downwardly from said outer portion and engaging an inner surface of the other of said inner and outer form walls, said outside bracket member extending downwardly from said outer portion and engaging an outer surface of the other of said inner and outer form walls, said first tubular member and said second tubular member being telescopically engaged at their inner portions, means for preventing relative movement between said first tubular member and said second tubular member, said means being attached to the inner portion of one of said first or second tubular members and selectively engaging the other of said first or second tubular members, additional means for preventing relative movement between the inner and outer form walls and a ground surface, said additional means being affixed to said outer portions of each of said first and second tubular members, wherein said inside and outside bracket members of said first tubular member engage one of said inner and outer form walls, and said inside and outside bracket members of said second tubular member engage the other of said inner and outer form walls, thereby preventing relative movement between the inner and outer form walls.

2. A frame for preventing relative movement between a concrete footing form inner and outer form walls, said frame being affixed to, and extending between, said inner and outer form walls along an upper portion of said form walls, said frame comprising:

a first tubular member having an inner portion and outer portion, said outer portion having an inside bracket member and an outside bracket member, each bracket member being affixed to the underside of said outer portion, said inside bracket member extending downwardly from said outer portion and engaging an inner surface of one of said inner and outer form walls, said outside bracket member extending downwardly from said outer portion and engaging an outer surface of one of said inner and outer form walls, a second tubular member having an inner portion and outer portion, said outer portion having an inside bracket member and an outside bracket member, each bracket member being affixed to the underside of said outer portion, said inside bracket member extending downwardly from said outer portion and engaging an inner surface of the other of said inner and outer form walls, said outside bracket member extending downwardly from said outer portion and engaging an outer surface of the other of said inner and outer form walls, said first tubular member and said second tubular member being telescopically engaged at their inner portions, means for preventing relative movement between said first tubular member and said second tubular member, said means being attached to the inner portion of one of said first or second tubular members and selectively engaging the other of said first or second tubular members, additional means for preventing relative movement between the inner and outer form walls and a ground surface, said additional means being affixed to said outer portions of each of said first and second tubular members, wherein said additional means for preventing relative movement between the inner and outer form walls and a ground surface comprises:

a channel member affixed to the outer portion of each of said first and second tubular members, a rod passing through said channel member and extending toward said ground surface, a tubular member slidably engaged on said rod, means for selectively fixing movement of said tubular member relative to said rod, and, a vertically restraining bracket member attached to said tubular member for engaging an underside of said inner and outer form walls and preventing relative movement between the inner and outer form walls and said ground surface, wherein said inside and outside bracket members of said first tubular member engage one of said inner and outer form walls, and said inside and outside bracket members of said second tubular member engage the other of said inner and outer form walls, thereby preventing relative movement between the inner and outer form walls.

* * * * *